US012295425B2

(12) United States Patent
Breiwa, III

(10) Patent No.: US 12,295,425 B2
(45) Date of Patent: May 13, 2025

(54) INDIRECT EXOTHERMAL VAPORIZATION MATRIX

(71) Applicant: DYNAVAP, LLC, DeForest, WI (US)

(72) Inventor: George R Breiwa, III, Dane, WI (US)

(73) Assignee: DynaVap, LLC, DeForest, WI (US)

( * ) Notice: Subject to any disclaimer, the term of this patent is extended or adjusted under 35 U.S.C. 154(b) by 800 days.

(21) Appl. No.: 17/426,042

(22) PCT Filed: Jan. 31, 2020

(86) PCT No.: PCT/US2020/016204
§ 371 (c)(1),
(2) Date: Jul. 27, 2021

(87) PCT Pub. No.: WO2020/160466
PCT Pub. Date: Aug. 6, 2020

(65) Prior Publication Data

US 2022/0087327 A1 Mar. 24, 2022

Related U.S. Application Data

(60) Provisional application No. 62/799,519, filed on Jan. 31, 2019.

(51) Int. Cl.
*A24F 47/00* (2020.01)
*A24F 42/20* (2020.01)
*A24F 42/60* (2020.01)

(52) U.S. Cl.
CPC ..... *A24F 42/60* (2020.01); *A24F 42/20* (2020.01)

(58) Field of Classification Search
CPC ..... A24F 42/60; A24F 42/20; A24F 40/40
See application file for complete search history.

(56) References Cited

U.S. PATENT DOCUMENTS 4,774,032 A * 9/1988 Coates ..... A61M 16/18 29/445
6,192,670 B1 2/2001 Kerrebrock
2003/0010476 A1* 1/2003 Gippert ..... A61M 16/18 165/10

(Continued)

FOREIGN PATENT DOCUMENTS

CN 101055151 A 10/2007
CN 105163614 A 12/2015

(Continued)

OTHER PUBLICATIONS

International Search Report and the Written Opinion of the International Searching Authority, PCT/US2020/016204, dated Apr. 14, 2020, 18 pgs.

(Continued)

*Primary Examiner* — Abdullah A Riyami
*Assistant Examiner* — Nelson R. Burgos-Guntin
(74) *Attorney, Agent, or Firm* — BoardmanClark, LLP

(57) ABSTRACT

An indirect exothermal vaporization matrix for selective vaporization and/or atomization of compounds is provided. The matrix may incorporate any one or more of the following features: capillary structures, vapor relief pathways, carbon filtering, recessed receiving areas, torus and tori geometry to provide uniform loading and/or reloading of the indirect exothermal vaporization matrix with various compounds, and the like.

13 Claims, 4 Drawing Sheets

(56) References Cited

U.S. PATENT DOCUMENTS

| | | | | |
|---|---|---|---|---|
| 2008/0021072 | A1* | 1/2008 | Luzenberg | A24F 42/60 514/343 |
| 2014/0053832 | A1* | 2/2014 | Postma | A24F 42/60 128/202.21 |
| 2014/0346689 | A1 | 11/2014 | Dubief | |
| 2015/0374035 | A1 | 12/2015 | Sanchez et al. | |
| 2016/0106155 | A1* | 4/2016 | Reevell | H05B 1/0297 131/329 |
| 2016/0295915 | A1* | 10/2016 | Jochnowitz | A24F 42/60 |
| 2017/0013877 | A1* | 1/2017 | Breiwa, III | A24F 40/10 |
| 2017/0280769 | A1* | 10/2017 | Li | A24B 15/283 |
| 2017/0340011 | A1* | 11/2017 | Batista | A24F 40/46 |
| 2017/0354180 | A1 | 12/2017 | Fornarelli | |
| 2018/0153215 | A1 | 6/2018 | Bell | |
| 2018/0303161 | A1* | 10/2018 | Bilat | A24B 15/167 |
| 2020/0323267 | A1* | 10/2020 | Breiwa, III | A24F 40/40 |
| 2022/0087327 | A1* | 3/2022 | Breiwa | A24F 42/20 |

FOREIGN PATENT DOCUMENTS

| | | | |
|---|---|---|---|
| CN | 105188428 | A | 12/2015 |
| CN | 107084036 | A | 8/2017 |
| CN | 107920594 | A | 4/2018 |
| CN | 109201361 | A | 1/2019 |
| WO | 20200160466 | A1 | 8/2020 |

OTHER PUBLICATIONS

Chuanqi Ding, Yanpeng Li, Bo Wang "The Design Concept and Structure Optimization of Water-Bath Vaporizer for Large Air Separator", pp. 19-23, Metallurgical Power, No. 02, Feb. 15, 2015.

* cited by examiner

INDIRECT EXOTHERMAL VAPORIZATION MATRIX

CROSS-REFERENCE TO RELATED APPLICATIONS

This application is a national phase filing of International Patent Application No. PCT/US2020/016204 entitled "INDIRECT EXOTHERMAL VAPORIZER MATRIC", which has an international filing date of Jan. 31, 2020, which claims priority to U.S. Provisional Patent Application, Ser. No. 62/799,519, filed Jan. 31, 2019, entitled INDIRECT EXOTHERMAL VAPORIZATION MATRIX, the entire content of both are hereby incorporated by reference herein in their entireties.

BACKGROUND

The present disclosure relates to the field of vaporizers, e-cigarettes and associated componentry. The present disclosure more specifically relates to the field of exothermal vaporizing and/or atomizing pulmonary administration devices.

In nearly all current and previous vaporizer type devices designed for administration of atomized and/or vaporized compounds, some type of electric heating element is utilized to provide the energy needed for dissemination of the described compounds. This heating element (usually a type of resistance wire coil) is typically in direct contact with some sort of wicking component and produces the vapor and/or atomized compound(s) through a direct conduction of thermal energy. Some of the primary drawbacks of this arrangement result from the direct contact of the high intensity heat source (typically electric resistance wire) with a type of wicking material. These drawbacks are a result of the electric resistance wire producing excessive temperatures in the process of delivering sufficient thermal energy to facilitate the vaporization, and/or atomization of the target compounds as well as the carrier fluid if present. This occurs due to both the geometry of the wire and the nature in which resistance wire functions. In order to have the correct resistance needed to produce adequate thermal intensity, as well as sufficient heat units with the voltage available in the device, the wire diameter needs to fall within a prescribed diameter and have the appropriate number of turns and length to create the correct ohm load. With the limited current available in most devices, this results in a rather thin or small cross-sectional diameter wire. The smaller the diameter the wire, the higher the temperature and, therefore, thermal intensity produced on the surface of the wire to deliver the same number of heat units. In a situation in which any part of the heat application system (typically the resistance coil in contact with the active compounds and/or carrier fluid) exceeds the carbonization or thermal breakdown temperature of the active compound or its carrier fluid, either the compounds or the carrier can be damaged or chemically modified, ranging from the production of off flavors, to the initiation of incomplete combustion and secondary or tertiary byproducts of thermal degradation.

In addition, most materials used as a matrix for vaporization and/or atomization are simply fibers of an approximate volumetric quantity. The traditional matrix is not engineered for the task, relative to surface area, viscosity of compounds, or vapor egress. This often results in less than optimized conversion of the materials intended for consumption into an ingestible format and can at the same time contaminate the desirable compounds with byproducts.

Thus, a need exists for a vaporization matrix, which overcomes one or more of these deficiencies.

SUMMARY

Accordingly, an indirect exothermal vaporization matrix for selective vaporization and/or atomization of compounds is provided. The matrix may incorporate any one or more of the following features: capillary structures, vapor relief pathways, carbon filtering, recessed receiving areas, torus and tori geometry to provide uniform loading and/or reloading of the indirect exothermal vaporization matrix with various compounds, and the like.

In one or more examples of embodiments, an indirect exothermal vaporization matrix is disclosed. The matrix includes a body having a distribution of apertures. The matrix also includes a series of peaks and valleys along an edge of the body. The body is a cylinder.

An indirect exothermal vaporization matrix comprising a torus geometry having capillary and/or surface tension retention features adapted to keep liquids trapped in a spaced geometric configuration that facilitates optimal heat transfer in conjunction with area for produced vapor egress.

An indirect exothermal vaporization matrix is also disclosed including a body having a distribution of apertures, a plurality of longitudinal ribs, one or more raised areas, and a coil securement mechanism. The body has a tapered shape in an uncoiled state. A series of peaks and valleys are provided along an edge of the body, wherein the series of peaks and valleys are seated below the outer, upper edge of the matrix. The body is a cylindrical coil.

These and other features and advantages of devices, systems, and methods are described in, or are apparent from, the following detailed descriptions and drawings of various examples of embodiments.

BRIEF DESCRIPTION OF DRAWINGS

Various examples of embodiments of the systems, devices, and methods will be described in detail, with reference to the following figures, wherein.

It should be understood that the drawings are not necessarily to scale. In certain instances, details that are not necessary to the understanding of the invention or render other details difficult to perceive may have been omitted. For ease of understanding and simplicity, common numbering of elements within the numerous illustrations is utilized when the element is the same in different Figures. It should be understood, of course, that the invention is not necessarily limited to the particular embodiments illustrated herein.

DETAILED DESCRIPTION

Referring, to the Figures, an indirect exothermal vaporization matrix for selective vaporization and/or atomization of compounds is shown.

Figure 1:
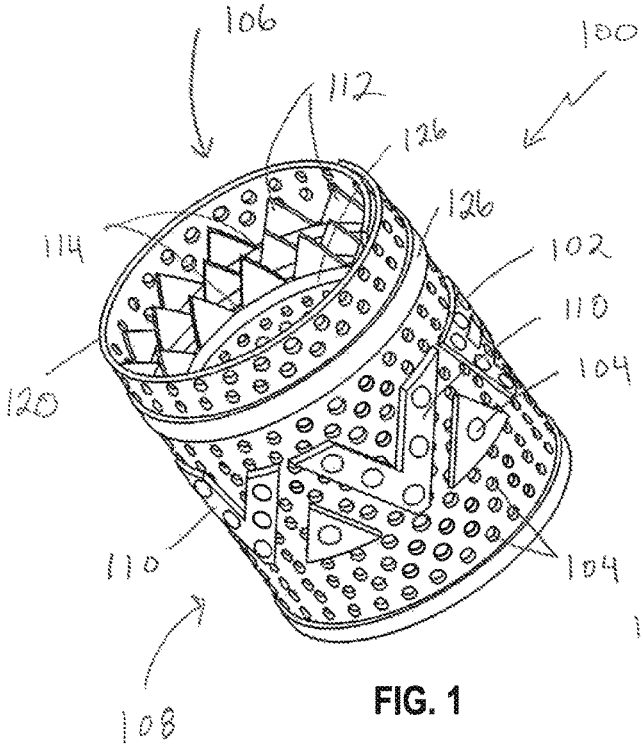
FIG. 1 is a perspective view of an indirect exothermal vaporization matrix according to one or more examples of embodiments.
Figure 2:
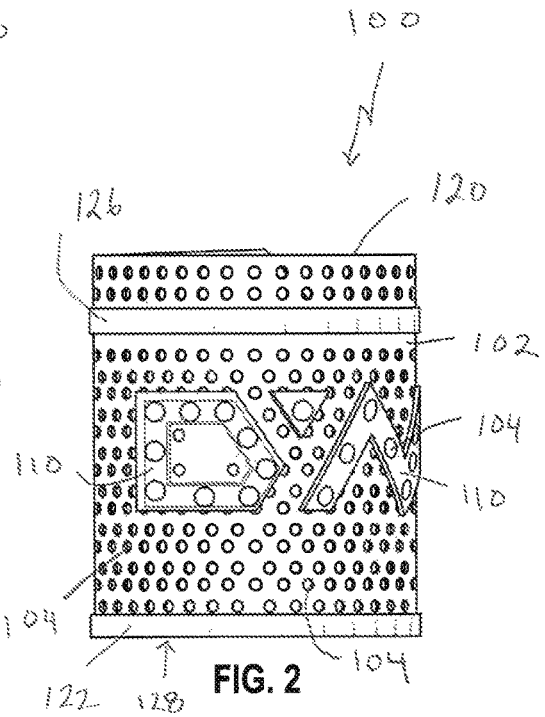
FIG. 2 is an elevation view of an indirect exothermal vaporization matrix of FIG. 1.
Figure 3:
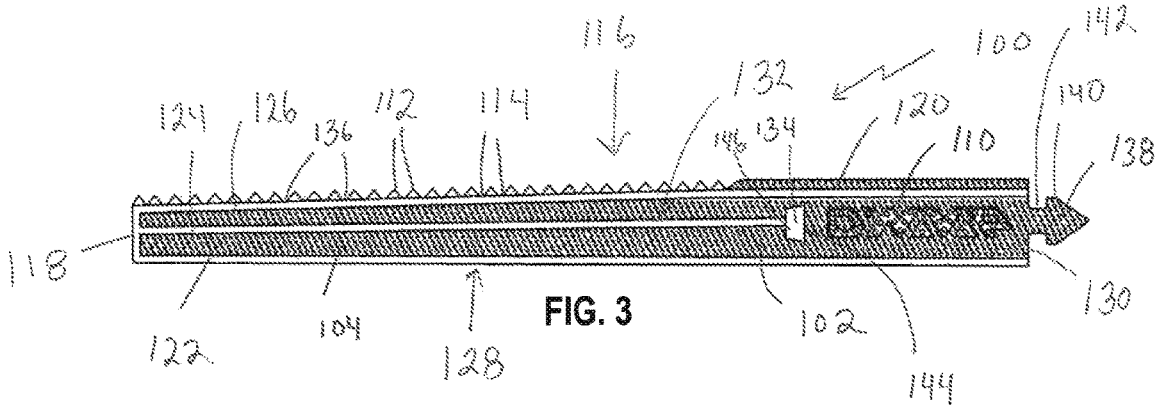
FIG. 3 is an elevation view of an indirect exothermal vaporization matrix of FIG. 1, showing the matrix in an uncoiled state.

In FIGS. 1-3, an indirect exothermal vaporization matrix 100 is shown. The indirect exothermal vaporization matrix is provided for selective vaporization and/or atomization of compounds. The matrix may incorporate any one or more of the following features: capillary structures, vapor relief pathways, carbon filtering, recessed receiving areas, torus and tori geometry to provide uniform loading and/or reloading of the indirect exothermal vaporization matrix with various compounds, and the like.

As illustrated, the matrix 100 may be shaped and profiled in a manner including features, recessed or protruding, adapted for fluid retention as well as vapor production. In one or more examples of embodiments, the matrix 100 has a shape which is optimized for providing such features or characteristics. Notably, these characteristics, namely fluid retention as well as vapor production, are difficult to obtain with a traditional wick and heating coil method. Accordingly, the indirect exothermal vaporization matrix 100 may comprise a variety of forms that accomplish the above-mentioned objectives. These features and shapes include, but are not limited to, cylinders with an open and/or porous bore and/or polygons similarly shaped as cylinders with faceted, grooved and/or, but not limited to, splined surfaces. An elongated torus, as well as compound tori, may also be suitable shapes. For example, the torus shape is well known for its liquid retention capability in nearly any orientation.

As can be seen in FIGS. 1-3, in one or more examples of embodiments, the indirect exothermal vaporization matrix 100 comprises a representative example of one or more of the described shapes, coupled with a means of capillary and/or surface tension retention features (described in greater detail below). These capillary and/or surface tension retention features are adapted to keep liquids trapped in a spaced or an intentionally spaced geometric configuration that facilitates optimal heat transfer in conjunction with adequate consideration or space or area for produced vapor egress.

To this end, the matrix 100 disclosed and illustrated herein comprises a cylindrical or coiled matrix body 102 having a plurality of capillary and/or surface tension retention features, vapor relief pathways, and/or carbon filtering mechanisms, such as, for example, apertures, raised areas, peaks and valleys, ribs, etc., thereon. These features are discussed in greater detail hereinbelow.

Referring to FIG. 3, which shows an example of an uncoiled matrix 100, the matrix comprises a body 102, which may be sheet of material, having a distribution of apertures 104 or small apertures that form capillary and/or surface tension retention features. The apertures 104 are arranged in a pattern which provides adsorptive and absorptive characteristics that achieve the desired ratio of liquid retention and surface area as well as vapor egress. As can be seen in FIG. 3, the apertures 104 cover a majority of the body 102 or sheet of material. However, less than a majority is also contemplated. Likewise, while the apertures 104 are described as "small," large apertures accomplishing the purposes provided may also be acceptable. The apertures may also be a variety of sizes and/or shapes or a uniform size and/or shape. In one or more examples of embodiments, the apertures 104 may be photo-etched or laser cut. However, one of skill in the art will appreciate that alternative means of forming the apertures 104 may be suitable for the purposes provided.

Accordingly, referring to FIGS. 1-3, the matrix 100 includes a plurality of apertures 104, spaced throughout the matrix material, and in the coiled or cylindrical or torus form these apertures 104 are spaced throughout the interior 106 and exterior 108 of the coiled matrix 100 (see FIGS. 1-2). The matrix 100 may also include one or more raised surfaces 110, such as shown in the illustrated examples of embodiments, which raised surfaces may also form capillary and/or surface tension retention features.

Referring again to the uncoiled matrix 100 shown in FIG. 3, the matrix 100 also includes a series of peaks 112 and valleys 114 along at least a portion of one edge 116 of the body 102 that may form capillary and/or surface tension retention features. In the illustrated embodiment, the series of alternating peaks 112 and valleys 114 extends along the top edge 116, beginning at a terminal end 118 of the uncoiled matrix 100 and ending at a longitudinal edge segment 120, which when coiled forms the outer circumference of the top edge of the indirect exothermal vaporization matrix 100. That is, a portion of the top edge 116 has a longitudinal edge segment 120. This longitudinal edge segment 120 forms a uniform upper edge and outer circumference of the matrix 100 when the matrix is coiled in a cylinder as shown in FIGS. 1-2.

In the uncoiled matrix 100 shown in FIG. 3, one or more longitudinal ribs 122, 124, 126 are also shown. The ribs may be provided for structural rigidity or support, as well as or alternatively for forming additional capillary and/or surface tension retention features. In the illustrated embodiment, three longitudinal ribs 122, 124, 126 are shown. A first rib 122 extends along or near a bottom edge 128 of the matrix 100. The first rib 122 extends from a terminal end 118 of the uncoiled matrix 100, to a second end or edge 130 of the uncoiled matrix 100. A second rib 124 extends along a central portion 132 of the uncoiled matrix 100 or body 102 and is approximately parallel to the first rib 122. The second rib 124 extends from the terminal end 118 of the uncoiled matrix 100 and terminates at an aperture 134 in the matrix 100 or body 102. A third rib 126 extends from the terminal end 118 of the uncoiled matrix 100 to the second end or edge 130 of the uncoiled matrix 100 and is positioned adjacent the series of peaks 112 and valleys 114. Preferably, the third rib 126 is positioned at the base 136 of the valleys 114. The third rib 126 may extend at an angle relative to the first and second ribs 122, 124. That is, the first rib 122, second rib 124, and third rib are closer together at the terminal end 118 than at the opposite end of the ribs.

To this end, as can be seen in the uncoiled matrix 100 shown in FIG. 3, in one or more examples of embodiments the uncoiled matrix 100 material may have a tapered width from one end 118 the other 130. The first end or terminal end 118 of the uncoiled matrix 100 is narrower than the second end 130 of the uncoiled matrix 100.

In the illustrated example, a coil securement mechanism is also shown. In the illustrated embodiment, the coil securement mechanism includes an insertion member 138, which in the illustrated embodiment in provided with a wide portion 140 and a narrow portion 142. In the illustrated embodiment, the insertion member 138 takes the form of an arrowhead shape. The insertion member 138 is provided on one end 130 of the uncoiled matrix 100. The insertion member 138 is inserted into or mates with an aperture 134 having a dimension suitable to receive the insertion member 138 and retain it therein when the matrix 100 is coiled. The aperture 134 in the matrix material is spaced from the insertion member 134 as shown on the uncoiled matrix 100 shown in FIG. 3. The aperture includes a wide portion 144 suitable for receipt of the wide portion 140 of insertion member 138, e.g., the wide portion of the arrowhead shape, and a narrow portion 146 suitable for retention of the insertion member 138 (e.g., narrower than the width of the insertion member wide portion 140, and generally sized to match the narrow portion 142). In the illustrated embodiment, the aperture 138 is a tapered opening in the matrix material. While specific examples are described, one of skill in the art will appreciate that variations thereon may be acceptable for accomplishing the purposes provided.

As can be seen in FIG. 1 and described herein, the cylindrical matrix 100 may be a coiled structure, forming a plurality of wall layers or in some examples of embodiments generally cylindrical layers. As can be interpreted from comparison of FIG. 3 and FIGS. 1-2, the uncoiled sheet is coiled/rolled, such that the narrower tapered end is on the interior of the coiled matrix 100 shown in FIG. 1 and the coil securement mechanism is attached through insertion of the arrowhead insertion member 138 into its receiving aperture. That is, to achieve a generally coiled or cylindrical or torus structure, in the illustrated example the uncoiled matrix material is rolled beginning with the terminal end 118 toward the second end 130. In the coiled form, the insertion member 138 is aligned with the insertion aperture 138 and may be inserted therein. The matrix 100 is retained in its coiled form by the engagement of the coil securement mechanism, and in particular the wide portion 140 of insertion member 138 with the narrow portion 146 of the aperture 138. When the matrix 100 material is coiled, the series of peaks 112 and valleys 114 forms an uneven or varied top surface (see FIG. 1). In addition, due to the tapered shape of the matrix 100, the top of each successive layer of the series of peaks 112 and valleys 114 in the coiled form is lower than the top of each adjacent outer layer of the coil. In this regard, the series of peaks 112 and valleys 114 are seated below the outer, upper edge 120 of the matrix 100 when coiled. While a specific example of forming a cylinder or a layered structure is described, one of skill in the art would appreciate that variations thereon may be acceptable for the purposes provided.

As indicated, the matrix 100 is constructed or formed in the uncoiled shape of FIG. 3 by, for example (but not limited to) photoetching or laser cut or mold, and/or combinations of the foregoing. While a photo-etched or laser cut sheet material is shown, other various organic and/or inorganic sheet materials may also be used which have improved adsorptive and absorptive characteristics and may achieve the desired ratio of liquid retention and surface area as well as vapor egress. Additional examples include, but are not limited to, semisolid composites of carbon and/or cellulosic materials, such as but not limited to: compressed wire matrices, bamboo, and/or balsa in various stages of pyrolysis. Cellulosic materials may present some useful structures and geometry difficult to recreate in a manufacturing environment. In one or more particular examples of embodiments involving the use of cellulosic materials, partially and/or fully pyrolyzed and/or heat-treated cellulosic materials may be desirable as un-heat treated materials may contribute their own volatile compounds when heated to the temperatures needed for dispensation. In another example of embodiments, various materials of a granular nature, such as but not limited to, spherical titanium or other suitable metals, as well as any number of other processed organic materials, such as cellulosic granules or carbonized sugar, may provide useful utility depending on the active compound's properties.

Additional examples of alternative embodiments include matrix of electroformed geometries. This process enables the design to incorporate extremely complex geometries including three-dimensional contours not achievable through the use of more standard fabrication methods.

Figure 4:
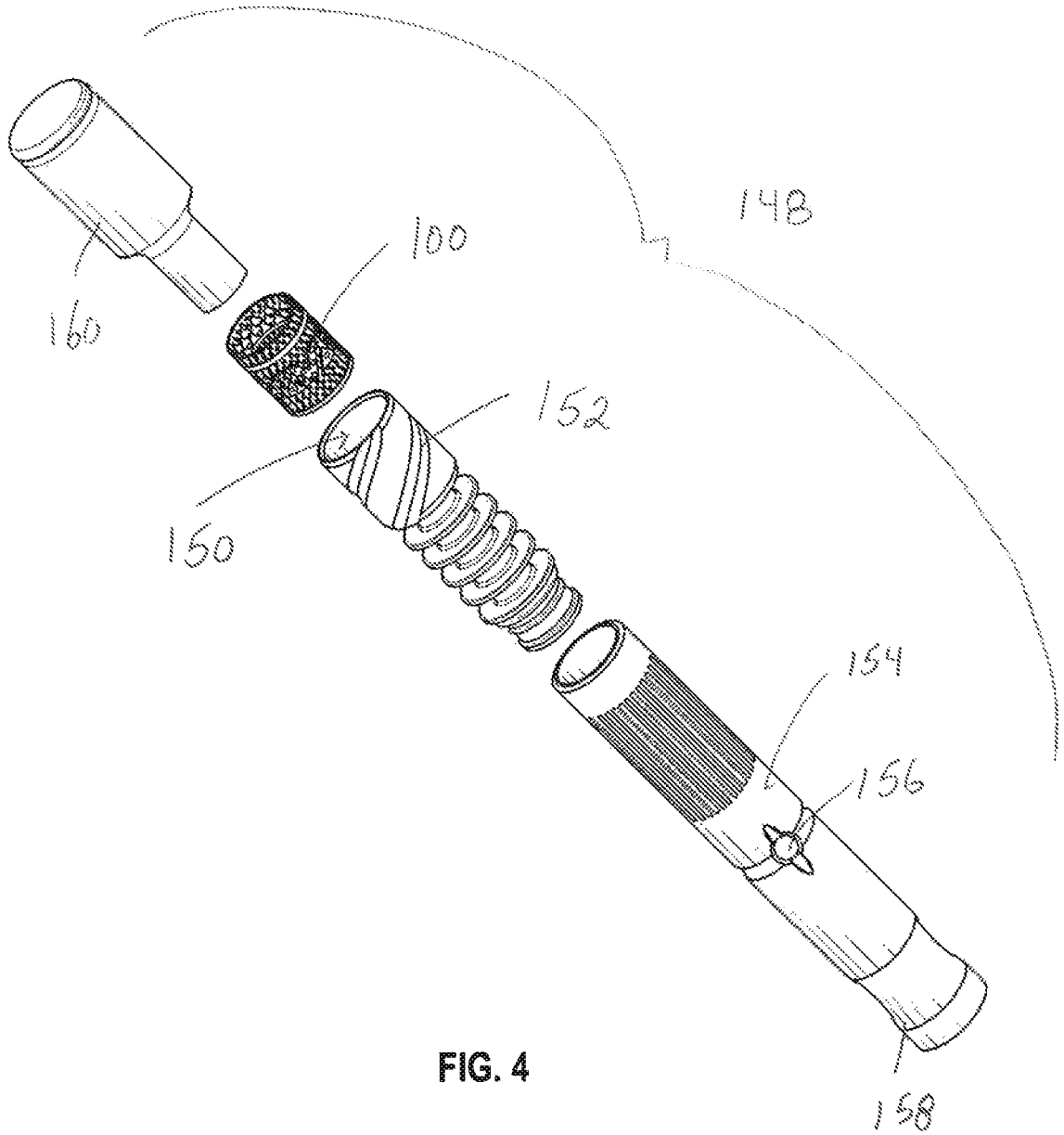
FIG. 4 is an exploded perspective view of an exothermal vaporizer having an indirect exothermal vaporization matrix of FIG. 1, according to one or more examples of embodiments.
Figure 5:
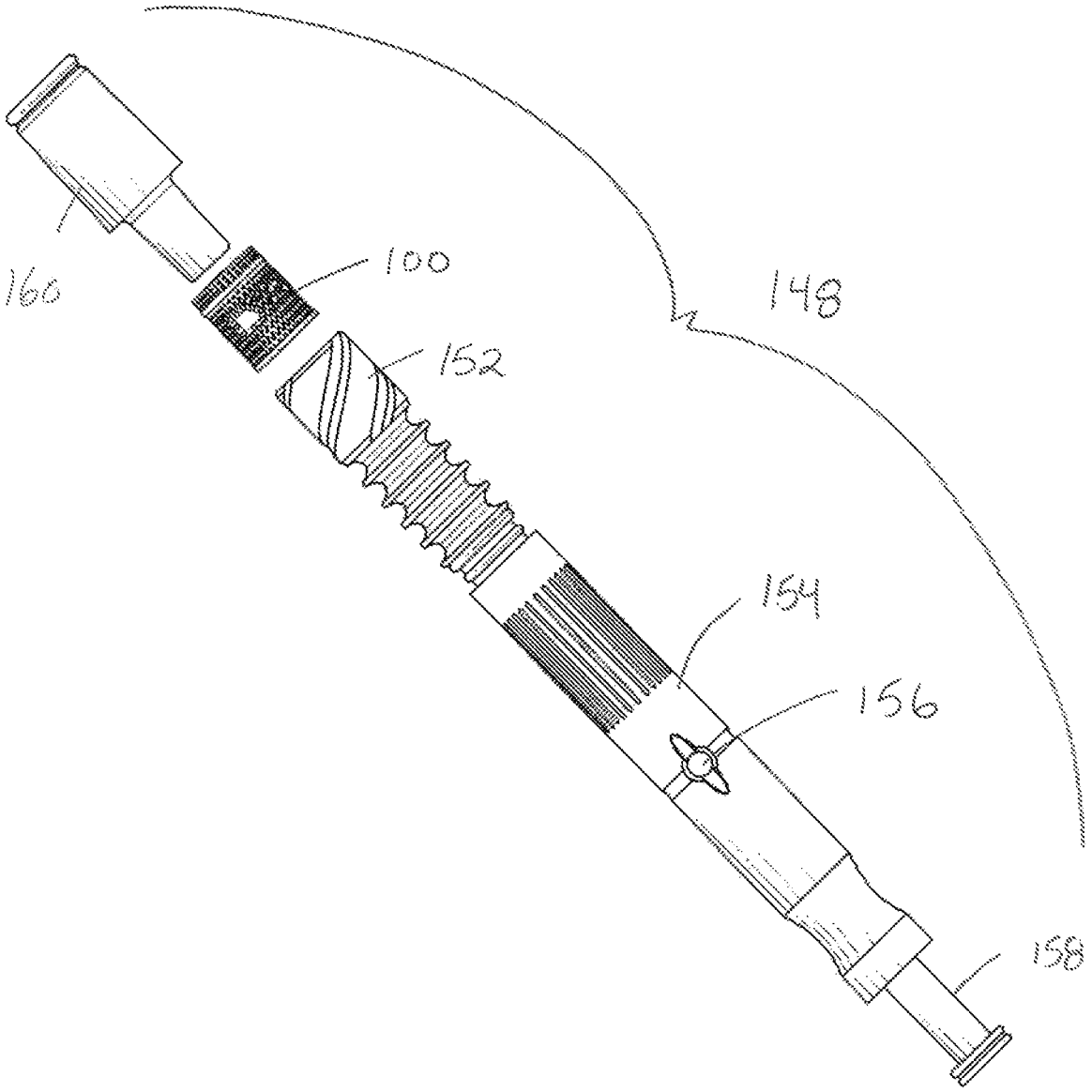
FIG. 5 is an additional exploded perspective view of an exothermal vaporizer having an indirect exothermal vaporization matrix of FIG. 1, according to one or more examples of embodiments, showing the vaporizer partially assembled before insertion of the indirect exothermal vaporization matrix and attachment of a cap.
Figure 6:
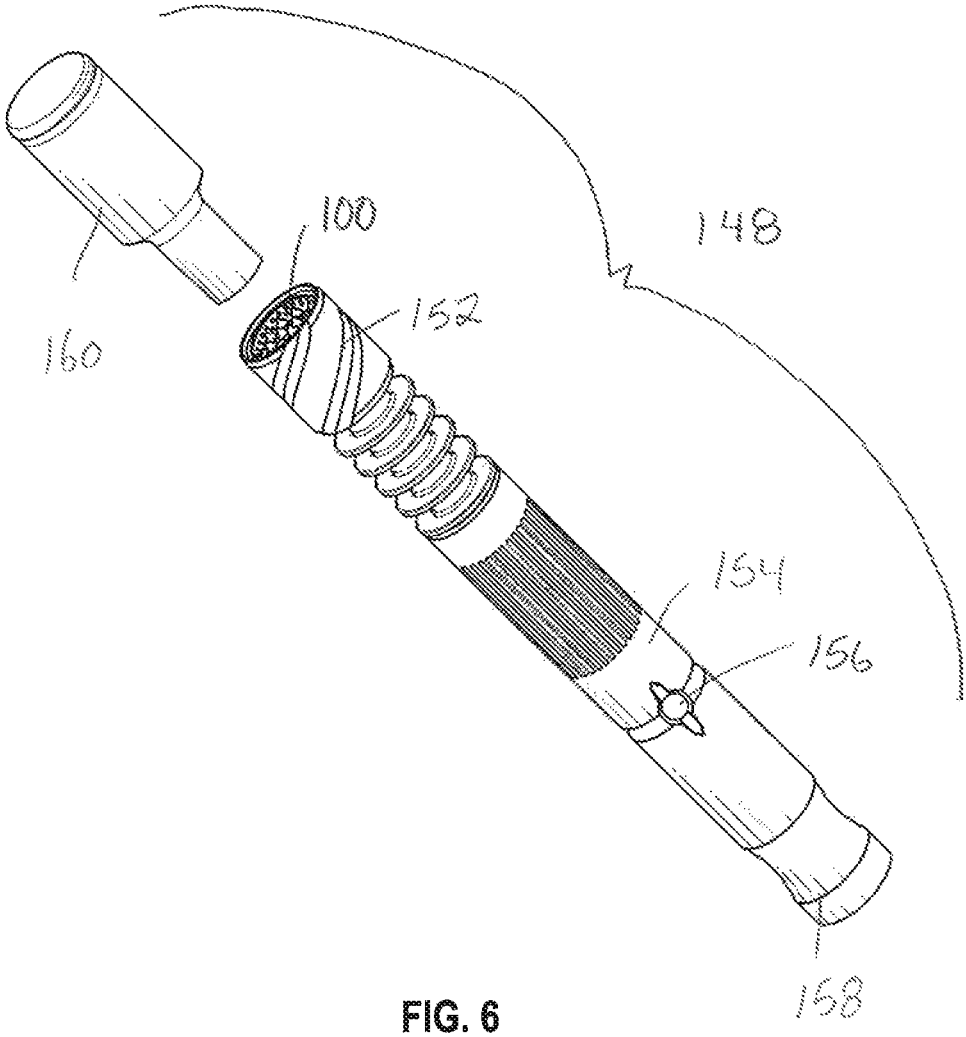
FIG. 6 is a perspective view of an exothermal vaporizer having an indirect exothermal vaporization matrix of FIG. 1 inserted therein, showing the cap of the exothermal vaporizer removed.

Referring to FIGS. 4-6, which show an exploded view of a vaporization device 148 and a vaporization device 148 in which the coiled matrix 100 is inserted into a recess 150 in the vaporization device (FIG. 6), it can be seen that the indirect exothermal vaporization matrix 100 may be used with an exothermal vaporizer 148. In this regard, the indirect exothermal vaporization matrix 100 may be used with any suitable exothermal vaporizer 148. One or more examples of an exothermal vaporizer 148 suitable for use with the matrix 100 described herein are shown in U.S. Patent Publication No. 2017/0013877, the entire contents of which is hereby incorporated by reference herein in its entirety, one example of which is illustrated herein in FIGS. 4-6. In particular, an exothermal vaporizer 148 is provided. The exothermal vaporizer 148 has a body 154 including an air and vapor mix port, a fluid inlet port in communication with a reservoir (e.g., recess or opening 150), an air inlet 156, and an evaporation matrix 100. A mouthpiece 158 is coupled to the body and a temperature indicating cap 160 which is removable from the body.

In the illustrated examples, the matrix 100 has an approximate cylindrical shape which is sized to be received within a mating cylindrical opening or recess 150 in a top portion 152 of the vaporization device 148 and may be seated therein. While a cylinder is described and shown, various geometric configurations accomplishing the purposes provided may be used.

The indirect exothermal vaporization matrix 100 provides a novel mechanism to retain liquid(s) and/or solid and/or semisolid meltable materials for vaporization within the vaporization device 148. That is, the indirect exothermal vaporization matrix 100 provides a different approach for retention and/or vaporizing and/or atomizing active compounds and their carrier fluids utilizing integrated heat sources. This is accomplished by, among other things, separating the heat source and control from the indirect exothermal vaporization matrix 100.

Function of the indirect exothermal vaporization matrix 100 is a derivative of more typical wicks. In other words, it may be similarly loaded with liquid or other materials to be vaporized—which are retained by the indirect exothermal vaporization matrix 100, e.g., on the surface area generated by the various apertures 104, peaks 112, valleys 114, surfaces 110, ribs 122, 124, 126, etc. —and subsequently heated using a vaporizer 148 and exothermal heat source. However, due to the engineered shape and physical structures present in the novel matrix described herein, the performance is more predictable and provides enhanced vapor production. This is accomplished via a more uniform structure and spacing of the fluid retaining structures, which while illustrated with one or more specific examples, may include nearly any sort of aperture, groove, rib, and/or perforation. These structures enhance the ability of the indirect exothermal vaporization matrix 100 to, not only be loaded with various material(s), but also facilitate both a more even distribution of heat and temperature, as well as consistent and predictable output of vapor and/or atomized compounds. Moreover, the matrix 100 may be reusable.

It is noted that, although in the examples described herein heat is preferably applied to the indirect exothermal vaporization matrix 100 from an external source, it is contemplated that the matrix 100 may be used in conjunction with a vaporizer having an internal heat source as the geometry of the indirect exothermal vaporization matrix 100 can also function well as an endothermic vaporization matrix.

In addition to the various advantages previously described herein, the use of an indirect exothermal vaporization matrix 100 provides several benefits including but not limited to: minimization of hot spots or areas of temperature exceeding those needed for either atomization or vaporization while also providing sufficient heat diffused across a large surface area to facilitate dispensation of the actives from the indirect exothermal vaporization matrix 100. Moreover, the structure may be produced at least in part via photoetching, which enables the creation of large numbers of small features in a production ready and cost-efficient manner.

By separating the direct heat source from the matrix 100 containing the active compounds and/or carriers it is possible to apply sufficient heat in a more diffused manner and avoid temperatures exceeding those, which could damage or alter any of the active and/or carrier compounds contained within the matrix 100 in an undesirable fashion. This method also substantially, or in some examples may completely eliminate the thermodegradation and/or carbonization of these compounds resulting in cleaner less contaminated vapor.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present disclosure.

While particular examples of embodiments are outlined above, various alternatives, modifications, variations, improvements and/or substantial equivalents, whether known or that are or may be presently foreseen, may become apparent to those having at least ordinary skill in the art. Accordingly, the examples of embodiments as set forth above are intended to be illustrative, not limiting. Various changes may be made without departing from the spirit or scope of the disclosure. Therefore, the disclosure is intended to embrace all known or earlier developed alternatives, modifications, variations, improvements and/or substantial equivalents.

The technical effects and technical problems in the specification are exemplary and are not limiting. It should be noted that the embodiments described in the specification may have other technical effects and can solve other technical problems.

The invention claimed is:

1. An indirect exothermal vaporization matrix comprising:

a body having a distribution of apertures;

a series of peaks and valleys along an edge of the body;

wherein the body is a cylinder;

wherein the body comprises a coil and has a coil securement mechanism; and wherein the coil securement mechanism comprises an insertion member and an aperture.

2. The indirect exothermal vaporization matrix of claim 1, wherein the body has a tapered shape in an uncoiled state, such that the series of peaks and valleys are seated below the outer, upper edge of the matrix.

3. The indirect exothermal vaporization matrix of claim 1, comprising a plurality of ribs on the body.

4. The indirect exothermal vaporization matrix of claim 1, comprising one or more raised areas.

5. The indirect exothermal vaporization matrix of claim 1, comprising a plurality of cylindrical layers of matrix material within the body.

6. An exothermal vaporizer comprising the indirect exothermal vaporization matrix of claim 1.

7. An indirect exothermal vaporization matrix comprising a torus geometry having capillary and/or surface tension retention features adapted to keep liquids trapped in, a spaced geometric configuration that facilitates optimal heat transfer in conjunction with area for produced vapor egress;

wherein the capillary and/or surface tension retention features are selected from the group consisting of apertures, raised areas, peaks and valleys, and ribs.

8. The indirect exothermal vaporization matrix of claim 7, comprising a plurality of layers of matrix material.

9. An exothermal vaporizer comprising the indirect exothermal vaporization matrix of claim 7.

10. An indirect exothermal vaporization matrix comprising:

a body having a distribution of apertures, a plurality of longitudinal ribs, one or more raised areas, and coil securement mechanism, wherein the body has a tapered shape in an uncoiled state;

a series of peaks and valleys along an edge of the body, wherein the series of peaks and valleys are seated below the outer, upper edge of the matrix; and wherein the body is a cylindrical coil.

11. The indirect exothermal vaporization matrix of claim 10, wherein the coil securement mechanism comprises an insertion member and an aperture.

12. The indirect exothermal vaporization matrix of claim 10, comprising a plurality of cylindrical layers of matrix material within the body.

13. An exothermal vaporizer comprising the indirect exothermal vaporization matrix of claim 10.

* * * * *